US011822274B2

(12) United States Patent
Kanno

(10) Patent No.: US 11,822,274 B2
(45) Date of Patent: Nov. 21, 2023

(54) FIXING DEVICE AND IMAGE FORMING APPARTATUS

(71) Applicant: Oki Electric Industry Co., Ltd., Tokyo (JP)

(72) Inventor: Yoshihiro Kanno, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 18/082,975

(22) Filed: Dec. 16, 2022

(65) Prior Publication Data

US 2023/0305464 A1 Sep. 28, 2023

(30) Foreign Application Priority Data

Mar. 28, 2022 (JP) ..... 2022-052308

(51) Int. Cl.
*G03G 15/20* (2006.01)

(52) U.S. Cl.
CPC ..... *G03G 15/2057* (2013.01)

(58) Field of Classification Search
None
See application file for complete search history.

(56) References Cited

U.S. PATENT DOCUMENTS

| | | | | |
|---|---|---|---|---|
| 6,456,819 | B1 | 9/2002 | Abe et al. | |
| 10,691,053 | B2 * | 6/2020 | Takada | G03G 15/553 |
| 2006/0210329 | A1 * | 9/2006 | Tsueda | G03G 15/2064 399/328 |
| 2011/0082260 | A1 | 4/2011 | Omata et al. | |
| 2013/0195491 | A1 | 8/2013 | Suzuki | |
| 2018/0246456 | A1 * | 8/2018 | Uekawa | G03G 15/553 |
| 2019/0377292 | A1 * | 12/2019 | Fujii | G03G 15/2064 |

FOREIGN PATENT DOCUMENTS

| | | | |
|---|---|---|---|
| JP | 2006312183 A | * | 11/2006 |
| JP | 2015-148760 A | | 8/2015 |

* cited by examiner

*Primary Examiner* — Sevan A Aydin
(74) *Attorney, Agent, or Firm* — Rabin & Berdo, P.C.

(57) ABSTRACT

A fixing device includes an annular belt having an outer circumferential surface, and a facing member that faces the outer circumferential surface of the annular belt to form a nip region. The annular belt is configured so that in measurement of a hardness of the outer circumferential surface using a hardness tester, a ratio (A/B) of a first hardness value (A) to a second hardness value (B) is 0.738 or more and 0.837 or less. The first hardness value (A) represents a measured value at a time when a measurement time corresponding to a time required for a predetermined point on the outer circumferential surface to pass through the nip region has elapsed after start of the hardness measurement. The second hardness value (B) represents a measured value at a time when the measured value by the hardness tester is saturated.

15 Claims, 5 Drawing Sheets

FIG. 8

| HEATING BELT | | 72A | 72B | 72C | 72D | 72E | 72F | 72G | 72H | 72I | 72J | 72K | 72L |
|---|---|---|---|---|---|---|---|---|---|---|---|---|---|
| ELASTIC LAYER | THICKNESS [μm] | 150 | 200 | 250 | 250 | 300 | 300 | 300 | 300 | 200 | 250 | 300 | 300 |
| | HARDNESS [degree] | 12 | 12 | 12 | 20 | 12 | 20 | 20 | 12 | 40 | 40 | 40 | 400 |
| SURFACE LAYER | THICKNESS [μm] | 17 | 20 | 20 | 13 | 17 | 27 | 19 | 17 | 14 | 16 | 15 | 13 |
| MEASURED HARDNESS VALUE | SATURATION HARDNESS VALUE [degree] | 80.8 | 78.1 | 76.4 | 79.0 | 73.0 | 81.6 | 77.5 | 72.4 | 78.3 | 81.4 | 84.7 | 82.4 |
| | HARDNESS VALUE AFTER 0.2s [degree] | 48.6 | 53.1 | 56.4 | 59.8 | 57.9 | 65.5 | 62.5 | 60.6 | 67.3 | 71.8 | 76.4 | 73.0 |
| HARDNESS RATIO AFTER 0.2s [degree] | | 0.601 | 0.680 | 0.738 | 0.757 | 0.793 | 0.803 | 0.806 | 0.837 | 0.860 | 0.882 | 0.902 | 0.886 |
| EVALUATION LEVEL | | 1 | 3 | 4 | 4 | 5 | 5 | 5 | 5 | 1 | 2 | 3 | 3 |

FIXING DEVICE AND IMAGE FORMING APPARATUS

BACKGROUND OF THE INVENTION

1. Field of the Invention

The present disclosure relates to a fixing device and an image forming apparatus, and more particularly those suitably applied to, for example, an electrophotographic printer.

2. Description of the Related Art

In recent years, some image forming apparatuses are configured to print an image, for example, by forming a toner image (also referred to as a developer image) using toner (also referred to as a developer) in a developing unit, transferring the toner image to a sheet (also referred to as a medium), and then fixing the toner image to the sheet by application of heat and pressure in a fixing device. The fixing device includes, for example, a roller and an annular belt which are provided below and above a sheet conveyance path. The fixing device is configured to nip the sheet at a nip portion formed between the roller and the belt and apply heat and pressure to the sheet.

There is a case where the imaging forming apparatus prints an image on a sheet with relatively large irregularities formed on its surface beforehand, such as so-called embossed paper. However, this type of sheet has a low toner fixability, especially at depressions. Thus, there is a proposed technique that improves the toner fixability by specifying the indentation depth of a fixing belt (see, for example, Patent Reference 1).

Patent Reference 1: Japanese Patent Application Publication No. 2015-148760 (FIG. 4 and the like)

SUMMARY OF THE INVENTION

There is a case where the image forming apparatus prints an image on a sheet with enhanced surface smoothness, such as so-called glossy paper. The glossy paper includes, for example, a base sheet and a resin layer laminated thereon. The resin layer enables the printed image to have high gloss.

However, the glossy paper has fine irregularities formed on a surface of the base sheet, and these fine irregularities may appear on a surface of the resin layer. Thus, the fixing device may fail to appropriately fix the toner to the glossy paper at areas where the fine irregularities are formed, even when the indentation depth of the fixing belt is set in the specified range as described above. As a result, in the image forming apparatus, part of the printed image may have no gloss. In other words, gloss unevenness may occur, and image quality may be degraded.

The present disclosure is made in consideration of the points described above, and an object of the present disclosure is to provide a fixing device and an image forming apparatus that improve the quality of an image fixed to a medium with fine irregularities formed on its surface.

In order to solve the above-described problem, a fixing device according to the present disclosure includes an annular belt having an outer circumferential surface, and a facing member that faces the outer circumferential surface of the annular belt to form a nip region between the annular belt and the facing member. The annular belt is configured so that in measurement of a hardness of the outer circumferential surface using a hardness tester, assuming that a first hardness value (A) represents a measured value at a time when a measurement time corresponding to a time required for a predetermined point on the outer circumferential surface to pass through the nip region has elapsed after start of the hardness measurement, and that a second hardness value (B) represents a measured value at a time when the measured value by the hardness tester is saturated, a ratio (A/B) of the first hardness value (A) to the second hardness value (B) is 0.738 or more and 0.837 or less.

A fixing device according to the present disclosure includes an annular belt having an outer circumferential surface, and a facing member that faces the outer circumferential surface of the annular belt to form a nip region between the annular belt and the facing member. The annular belt includes a base, an elastic layer formed on a surface of the base and having a thickness of 250 to 300 [μm], and a surface layer formed on a surface of the elastic layer and having a thickness of 15.0 to 29.6 [μm]. The annular belt is configured so that in measurement of a hardness of the outer circumferential surface using a hardness tester, a measured value is 56.4 [degree] or more and 65.5 [degree] or less when a measurement time corresponding to a time required for a predetermined point on the outer circumferential surface to pass through the nip region has elapsed after start of the hardness measurement.

Further, an image forming apparatus according to the present disclosure includes a developing unit that causes a developer image using a developer to adhere to a surface of a medium, and the fixing device having the above-described configuration to fix the developer image to the medium.

In the present disclosure, the ratio of the first hardness value to the second hardness value of the annular belt is appropriately specified, and thus the annular belt can deform to fit fine irregularities on the medium within a passage time during which the medium passes through the nip region together with the annular belt. Consequently, the developer adhering to both of planar parts and fine irregularities on the medium can be uniformly fixed to the medium, and thus an image with uniform gloss can be formed.

Therefore, the present disclosure can achieve the fixing device and the image forming apparatus that improve the quality of an image fixed to a medium with fine irregularities formed on its surface.

BRIEF DESCRIPTION OF THE DRAWINGS

FIG. 8 is a table showing values of respective parts of the heating belt, measurement results, and evaluation levels.

DETAILED DESCRIPTION OF THE INVENTION

The embodiment and modifications of the present disclosure will be described below with reference to the drawings.

[1. Configuration of Image Forming Apparatus]

Figure 1:
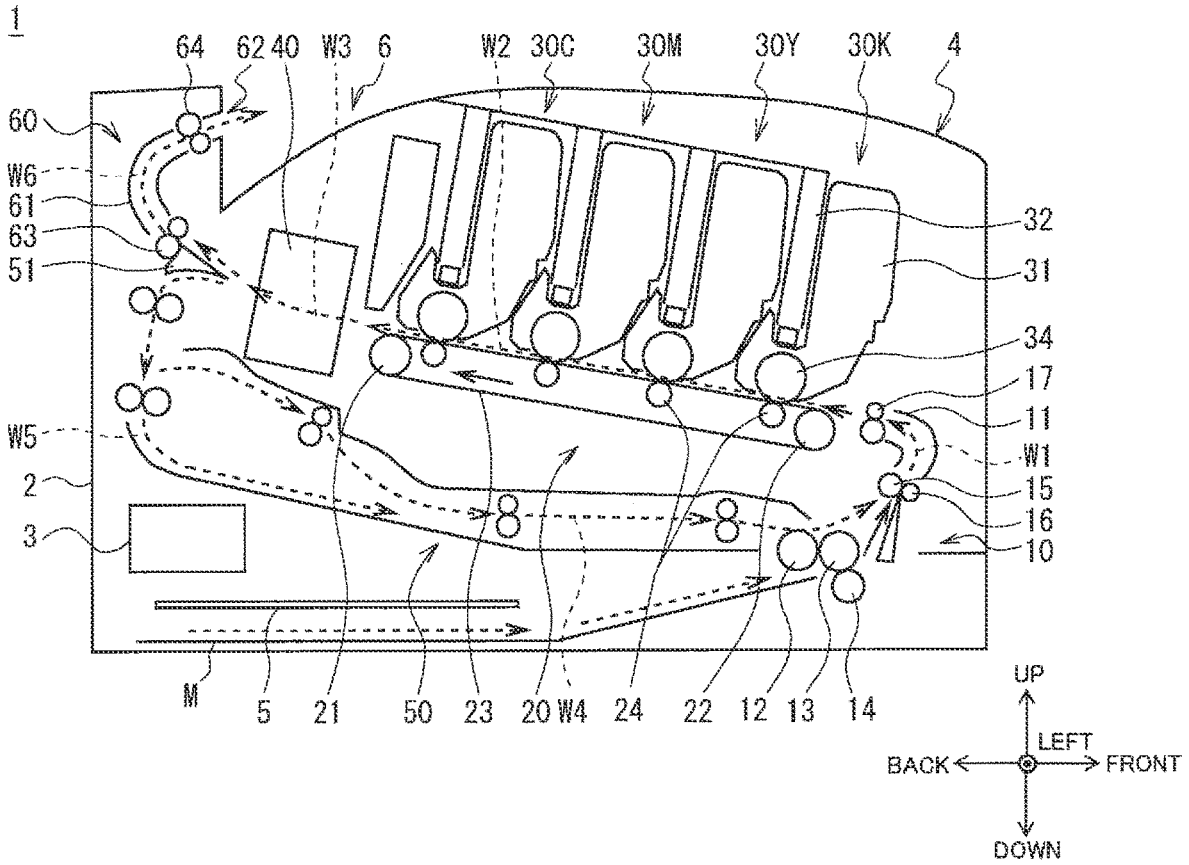
FIG. 1 is a schematic diagram illustrating a configuration of an image forming apparatus.

As illustrated in FIG. 1, an image forming apparatus 1 is an electrophotographic printer and is capable of forming (printing) a color image on a medium M such as plain paper or coated paper. For example, the image forming apparatus 1 is a single function printer (SFP) that has only a printer function, and does not have an image scanning function of reading a document, a communication function using a telephone line, or the like.

The image forming apparatus 1 includes various components disposed inside a housing 2 having a substantially box shape. In the following description, a right end portion in FIG. 1 is defined as a front of the image forming apparatus 1. Further, a vertical direction, a left-right direction, and a front-back direction are defined as those when the image forming apparatus 1 is viewed facing its front. The image forming apparatus 1 is capable of printing on a medium M of A3 size at maximum. The image forming apparatus 1 forms an image while conveying the medium M of A3 size along a conveyance path described later so that the short sides of the medium M are oriented in the left-right direction. Thus, each part of the image forming apparatus 1 has a length corresponding to the short sides of A3 size (297 [mm]) in the left-right direction.

The image forming apparatus 1 is controlled entirely by a controller 3. The controller 3 is connected to a host device such as a not shown computer. Upon receiving a printing instruction or printing data from the host device, the controller 3 executes an image forming process (also referred to as a printing process) to form a printed image on a surface of the medium M.

An operation panel 4, which displays various information and accepts operation inputs, is provided near the front of the upper surface of the housing 2. The operation panel 4 has light emitting diodes (LEDs), a touch panel including a combination of a display panel such as a liquid crystal panel and a touch sensor, and the like. Under the control of the controller 3, the operation panel 4 displays various information and accepts operation inputs from the user.

A tray 5 in which the media M are stored is provided at the bottom in the housing 2. The tray 5 is capable of storing the media M of A3 size at maximum with its short sides are oriented in the left-right direction. A feeding conveyance unit 10 is provided on the upper front side of the tray 5. The feeding conveyance unit 10 has conveyance guides 11 provide to face each other with a predetermined interval therebetween. The conveyance guides 11 form a feeding conveyance path W1, which is a route for conveying the medium M.

In the feeding conveyance unit 10, a pickup roller 12, a feeding roller 13, a separation roller 14, a registration roller 15, a pressure roller 16, a pair of conveyance rollers 17, and the like are arranged along the feeding conveyance path W1. Each roller has a columnar shape with its central axis oriented in the left-right direction and is rotatably supported. A driving force from a not shown feeding motor is transmitted to some of the rollers. The conveyance rollers 17 are disposed facing each other across the feeding conveyance path W1, and the conveyance rollers 18 are disposed facing each other across the feeding conveyance path W1.

In the feeding conveyance unit 10, the respective rollers rotate under the control of the controller 3 to pick up and convey the media M stacked and stored in the tray 5 while separating the media M from one another. Specifically, the pickup roller 12 draws the medium M from the tray 5. The feeding roller 13 advances the medium M drawn from the tray 5 by the pickup roller 12, along the feeding conveyance path W1. The separation roller 14 separates the topmost medium M from the other media M when a plurality of media M are taken out of the tray 5. The registration roller 15 and the pressure roller 16 correct the posture (orientation of each side with respect to an advancing direction) of the medium M when the medium M is skewed with respect to the feeding conveyance path W1, and advance the medium M correctly. The pair of conveyance rollers 17 convey the medium M along the feeding conveyance path W1, and further send out the medium M obliquely upward and backward.

On the upper rear side of the pair of conveyance rollers 17 in the feeding conveyance unit 10, a transfer unit 20 is disposed at the lower side, and four developing units 30 are disposed above the transfer unit 20. A straight transfer conveyance path W2 is formed between the transfer unit 20 and each developing unit 30. The transfer conveyance path W2 is connected to the feeding conveyance path W1 and extending obliquely upward and backward.

The transfer unit 20 includes a drive roller 21, an idle roller 22, a transfer belt 23, four transfer rollers 24, and the like. Each of the drive roller 21, the idle roller 22, and the transfer rollers 24 has a columnar shape with its central axis oriented in the left-right direction and is rotatably supported.

The drive roller 21 is disposed on the relatively rear side and can be rotated by a driving force supplied from a not shown drive power source. The idle roller 22 is disposed at the lower front side of the drive roller 21 and slightly away from the drive roller 21. That is, the idle roller 22 is disposed near the pair of conveyance rollers 17. The transfer rollers 24 are arranged at substantially equal intervals between the drive roller 21 and the idle roller 22.

The transfer belt 23 is a flexible, endless belt, and is stretched around the drive roller 21, the idle roller 22, and the transfer rollers 24. An upper portion of the transfer belt 23 is stretched straightly along the transfer conveyance path W2. Uppermost portions of the transfer rollers 24 are in contact with an inner circumferential side of the upper portion of the transfer belt 23. Thus, in the transfer unit 20, when the drive roller 21 rotates counterclockwise in FIG. 1, it causes the transfer belt 23 to move and causes the idle roller 22 and the transfer rollers 24 to rotate. The upper portion of the transfer belt 23 moves obliquely upward and backward along the transfer conveyance path W2.

The four developing units 30 (30K, 30Y, 30M and 30C) are also referred to as image forming units, and are arranged along the transfer conveyance path W2 above the transfer unit 20, i.e., in the oblique direction from the lower front side to the upper rear side. The developing units 30 respectively correspond to black (K), yellow (Y), magenta (M), and cyan (C). The developing units 30 are configured in the same manner except for color.

The developing unit 30 includes a development processing unit 31 and an exposure processing unit 32. The development processing unit 31 has a toner storage unit that stores a toner as a developer, a plurality of rollers, a photosensitive drum 34, and the like. Among these components, each of the rollers and the photosensitive drum 34 has a columnar or cylindrical shape with its central axis oriented in the left-right direction and is rotatably supported. The photosensitive drum 34 is located at the lowermost side in the development processing unit 31 and is in contact with the transfer belt 23 so as to nip the transfer belt 23 between the transfer roller 24 and the photosensitive drum 34.

The exposure processing unit 32 includes a plurality of LEDs arranged in the left-right direction above the corresponding photosensitive drum 34. In the exposure processing unit 32, the LEDs emit light under the control of the controller 3 to expose an outer circumferential surface of the photosensitive drum 34, thereby forming an electrostatic latent image. The development processing unit 31 causes the toner to adhere to the outer circumferential surface of the photosensitive drum 34 to form a toner image (also referred to as a developer image).

When the medium M is conveyed along the transfer conveyance path W2, the transfer unit 20 transfers the toner image from the photosensitive drum 34 to the medium M and causes the toner image to adhere to the surface of the medium M.

A fixing unit 40 as a fixing device (i.e., fuser) is disposed on the rear side of the transfer unit 20, i.e., on the rear side of the rearmost developing unit 30C. The fixing unit 40 fixes the toner image to the surface of the medium M by applying heat and pressure to the medium M while conveying the medium M along a fixing conveyance path W3 and sends the medium M obliquely upward and backward (to be described in detail).

A double-sided printing unit 50 is located at the lower side and rear side of the fixing unit 40. The double-sided printing unit 50 includes a switching unit 51 provided on the rear side of the fixing unit 40, a plurality of conveyance guides, a plurality of pairs of conveyance rollers, and the like. These components form a circulation conveyance path W4, a temporary evacuation conveyance path W5, and the like. The circulation conveyance path W4 is formed to connect the switching unit 51 and the pair of conveyance rollers 17 of the feeding conveyance unit 10.

When performing double-sided printing, the double-sided printing unit 50 switches the switching unit 51 under the control of the controller 3 to advance the medium M to the temporary evacuation conveyance path W5. Subsequently, after the end of the medium M passes through the switching unit 51, the double-sided printing unit 50 reverses the advancing direction of the medium M, and advances the medium M along the circulation conveyance path W4. The circulation conveyance path W4 connects to the feeding conveyance path W1 of the feeding conveyance unit 10 at the vicinity of the pair of conveyance rollers 17. As a result, the double-sided printing unit 50 enables the medium M to advance from the feeding conveyance path W1 to the transfer conveyance path W2 again in a state where the medium M is turned over, so that an image can be transferred to the back side of the medium M. In this regard, the double-sided printing unit 50 advances the medium M obliquely upward and backward when double-sided printing is not performed on the medium M and when the image is transferred to the back side of the medium M.

An ejection conveyance unit 60 is disposed on the upper rear side of the switching unit 51. The ejection conveyance unit 60 has a configuration partially similar to a part of the feeding conveyance unit 10. The ejection conveyance unit 60 has conveyance guides 61 facing each other with a predetermined interval therebetween. The conveyance guides 61 form a sheet ejection conveyance path W6, which is a route for conveying a medium M. An ejection port 62 is formed at the end of the path W6. The ejection conveyance unit 60 includes pairs of conveyance rollers 63 and 64 and the like arranged in this order along the sheet ejection conveyance path W6.

In the ejection conveyance unit 60, the pairs of conveyance rollers 63 and 64 are rotated under the control of the controller 3 to convey the medium M, which has been introduced from the fixing unit 40 via the switching unit 51, along the sheet ejection conveyance path W6 and to eject the medium M through the ejection port 62. The ejected medium M is placed on an ejection tray 6 formed on a top surface of the housing 2.

In this way, the image forming apparatus 1 conveys the medium M along the conveyance paths W, transfers a toner image formed by the developing unit 30 to the medium M, and then fixes the toner image to the medium M in the fixing unit 40. Thus, the image forming apparatus 1 is able to form an image, i.e., to perform printing.

[2. Configuration of Fixing Unit]

Figure 2:
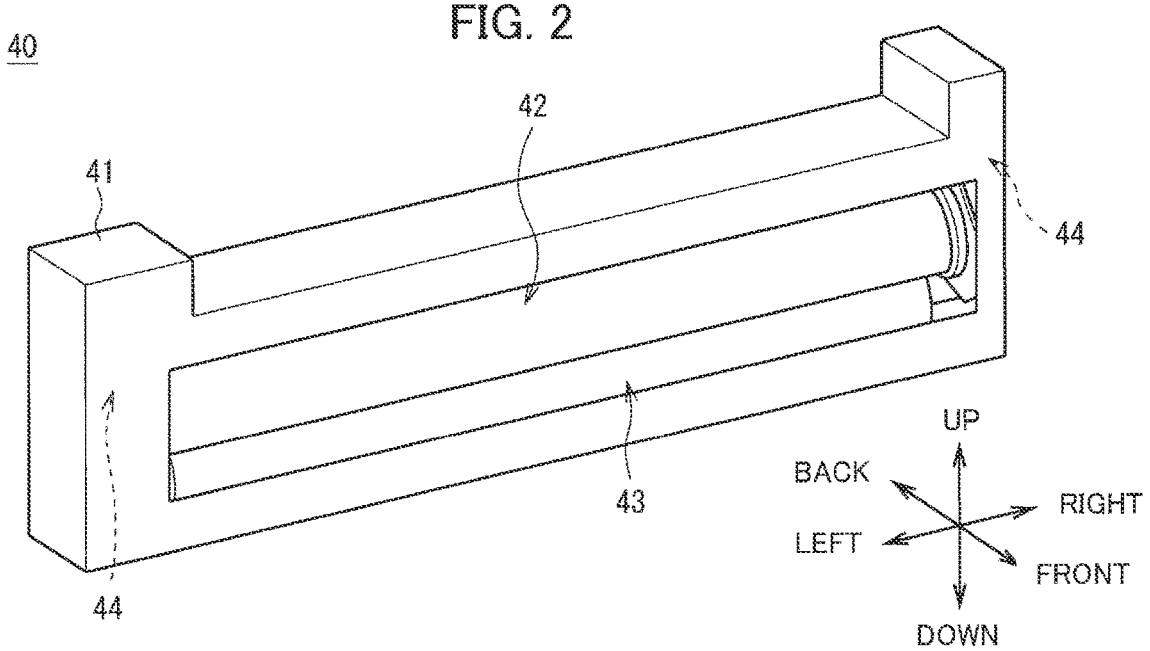
FIG. 2 is a schematic perspective view illustrating a configuration of a fixing unit.
Figure 3:
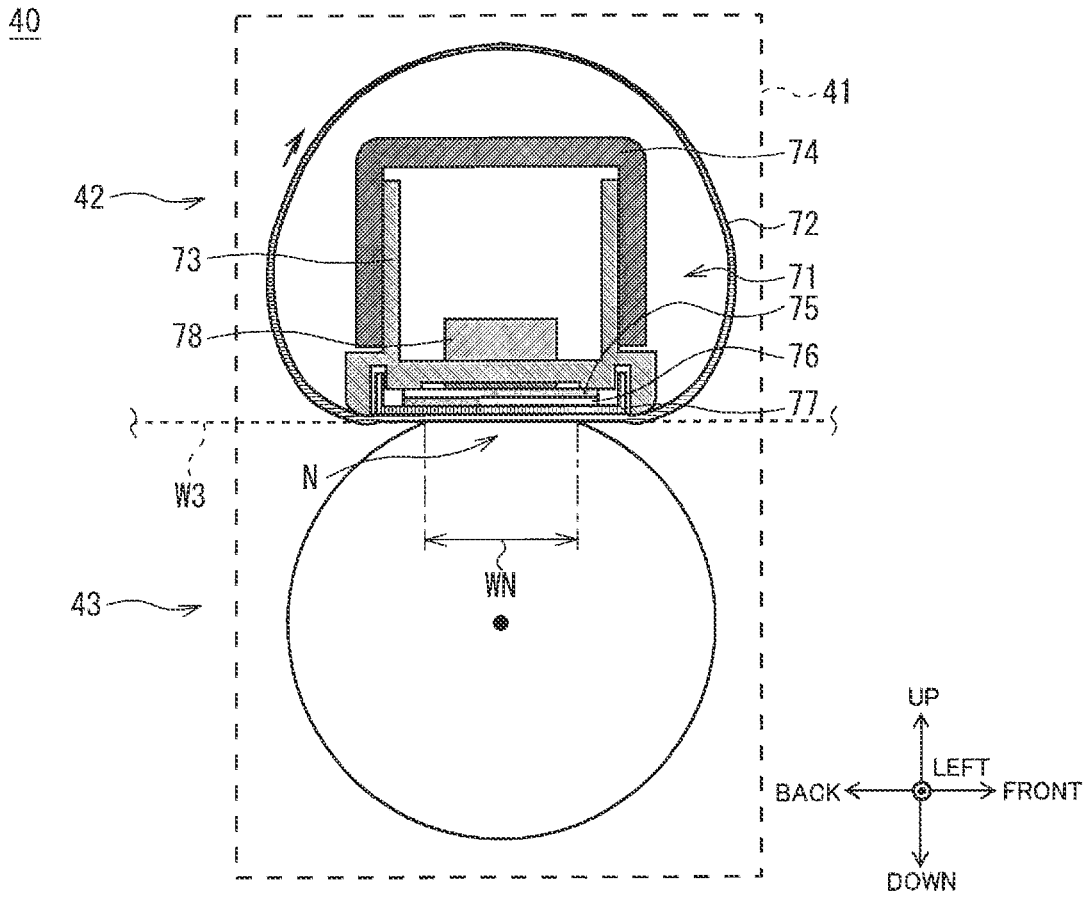
FIG. 3 is a schematic cross-sectional view illustrating the configuration of the fixing unit.

Next, the configuration of the fixing unit 40 will be described. FIG. 2 is a schematic perspective view of the fixing unit 40. FIG. 3 is a schematic cross-sectional view of the fixing unit 40. As illustrated in FIG. 2, the fixing unit 40 has a rectangular parallelepiped shape as a whole elongated in the left-right direction.

The fixing unit 40 is configured so that a plurality of components are incorporated inside a hollow fixing housing 41 that has a rectangular parallelepiped shape. On the front side and the back side of the fixing housing 41, elongated holes that are elongated in the left-right direction and penetrate the fixing housing 41 in the front-back direction are formed. The elongated holes allow the medium M to pass through the fixing housing 41.

Inside the fixing housing 41, a heating section 42 is disposed on the upper side, and a pressurizing section 43 is disposed on the lower side. The heating section 42 has a columnar shape as a whole with its central axis oriented in the left-right direction. The heating section 42 is supported by the fixing housing 41 so that the heating section 42 is displaceable in the substantially vertical direction.

As illustrated in FIG. 3, the heating section 42 mainly includes a heating central portion 71 located at its center and a heating belt 72 provided to surround the heating central portion 71. The heating central portion 71 has a hollow rectangular parallelepiped shape as a whole that is elongated in the left-right direction. The heating central portion 71 includes support bodies 73 and 74, a heat transfer plate 75, a heater 76, a partition plate 77, a temperature sensor 78, and the like.

The support body 73 is a molded part and is made of, for example, a heat-resistant resin material. The support body 73 is in the form of a hollow quadrangular prism extending in the left-right direction as a whole with its top surface removed. The support body 74 is formed, for example, by bending a plate-shaped metal member. The support body 74 is in the form of a hollow quadrangular prism extending in the left-right direction as a whole with its bottom surface removed. A front side plate of the support body 74 is in contact with the front side of a front side plate of the support body 73. A back side plate of the support body 74 is in contact with the back side of a back side plate of the support body 73. Thus, the support bodies 73 and 74 are combined to each other to form one quadrangular prism extending in the left-right direction as a whole.

The heat transfer plate 75 has a plate shape that is elongated in the left-right direction and thin in the vertical direction. The heat transfer plate 75 is located below a lower plate of the support body 73. The heat transfer plate 75 is made of a metal material with relatively high thermal conductivity, such as stainless steel, for example. The heat transfer plate 75 efficiently transfers heat generated by the heater 76 to be described later. The heater 76 as a heating member has a plate shape that is elongated in the left-right direction and thin in the vertical direction. The heater 76 is located below the support body 73. The heater 76 generates heat by electric power supplied from a predetermined power supply unit under the control of the controller 3 (FIG. 1).

The partition plate 77 mainly includes a lower plate having a plate shape that is elongated in the left-right direction and thin in the vertical direction. The partition plate 77 also includes a front plate and a back plate which are bent upward from the front and back sides of the lower plate, respectively. In the partition plate 77, the lower plate is located under the heater 76 to separate the heater 76 from the heating belt 72, so that the heater 76 and the heating belt 72 do not come into direct contact with each other.

The temperature sensor 78 is located above the lower plate inside the support body 73. The temperature sensor 78 detects the temperature of the heater 76 via the heat transfer plate 75, generates an electrical signal corresponding to the detected temperature, and sends the electrical signal to the controller 3 (FIG. 1). The controller 3 controls electric power to be supplied to the heater 76 based on the electric signal from the temperature sensor 78, thereby adjusting the temperature of the heater 76 to a desired temperature.

Figure 4:
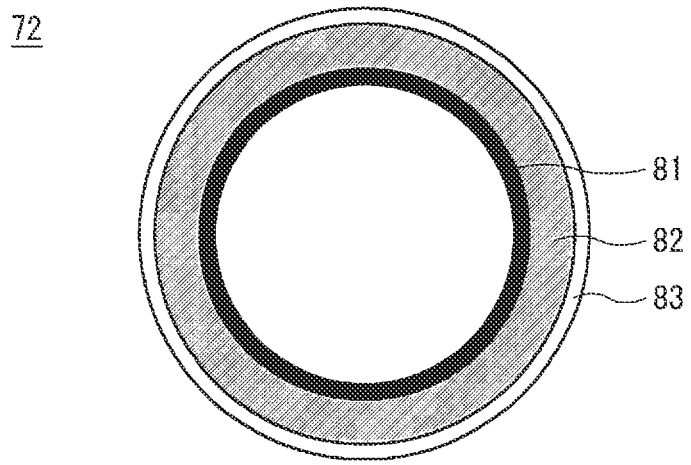
FIG. 4 is a schematic cross-sectional view illustrating a configuration of a heating belt.

The heating belt 72 as an annular belt is an endless belt that has a hollow cylindrical shape and has a sufficient length in the left-right direction. The heating belt 72 is provided to move around the heating central portion 71. As illustrated in a schematic cross-sectional view of FIG. 4, the heating belt 72 has a layered structure in which three types of members, namely, a base 81, an elastic layer 82, and a surface layer 83, are stacked in this order.

The base 81 is located at the innermost side of the heating belt 72 and is made of polyimide, for example. The thickness of the base 81 can be approximately 50 to 120 [μm]. In this embodiment, the thickness of the base 81 is set to approximately 70 to 90 [μm]. The base 81 can also be made of a metal material. In this case, the thickness of the base 81 can be approximately 20 to 60 [μm].

The elastic layer 82 is located between the base 81 and the surface layer 83 and is made of silicone rubber, for example. The thickness of the elastic layer 82 can be approximately 100 to 350 [μm], and is approximately 150 to 300 [μm] in this embodiment. The hardness of silicone rubber that forms the elastic layer 82 is desirably approximately 7 to 50 [degree] using a durometer type A (Shore A) measurement method based on JIS K 6253. In this embodiment, a material having a hardness of approximately 12 to 40 [degree] is used for the elastic layer 82.

The surface layer 83 is located on the outermost side of the heating belt 72 and is made of, for example, tetrafluoroethylene-perfluoroalkylvinyl ether copolymer (PFA). The thickness of the surface layer 83 can be approximately 8 to 40 [μm]. In this embodiment, the thickness of the surface layer 83 is set to approximately 13 to 30 [μm]. The surface layer 83 forms an outer circumferential surface of the heating belt 72.

In this regard, a liquid lubricant is applied to an inner circumferential surface of the heating belt 72. Thus, the liquid lubricant is interposed between the partition plate 77 and the heating belt 72. Consequently, the heating belt 72 can slide smoothly with respect to the partition plate 77.

Figure 5:
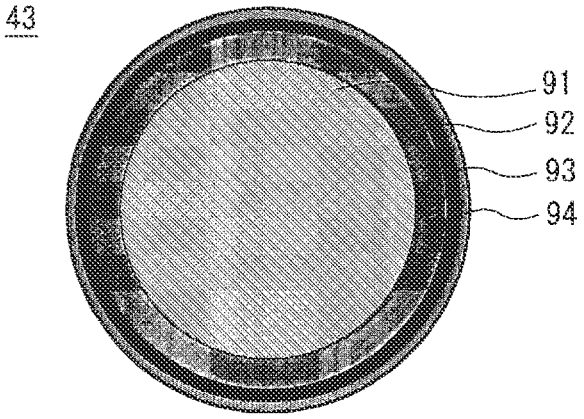
FIG. 5 is a schematic cross-sectional view illustrating a configuration of a pressurizing section.

The pressurizing section 43 (FIGS. 2 and 3) as a facing member is formed as a whole to have a columnar shape with its central axis oriented in the left-right direction. The diameter of the pressurizing section 43 is approximately 30 [mm]. The pressurizing section 43 is also referred to as a pressurizing roller. As illustrated in a schematic cross-sectional view of FIG. 5, the pressurizing section 43 has an elastic layer 92, a primer layer 93, and a surface layer 94 that are stacked on a central material 91 in this order.

The central material 91 as a center shaft is made of free-cutting steel (also referred to as SUM), for example. The central material 91 has a columnar shape with its central axis oriented in the left-right direction. The diameter of the central material 91 is approximately 24 [mm]. The elastic layer 92 is made of, for example, silicone rubber. The elastic layer 92 is formed on the outer circumferential surface of the central material 91 so that the thickness of the elastic layer 82 is approximately 3 [mm]. The primer layer 93 is made of, for example, a non-conductive RTV (Room Temperature Vulcanizing) silicone rubber. The primer layer 93 is formed on the outer circumferential surface of the elastic layer 92 so that the thickness of the primer layer 93 is approximately 5 [μm] or less. The surface layer 94 is made of, for example, a non-conductive PFA, and the thickness of the surface layer 94 is 15 to 25 [μm].

In addition, compression springs 44 are provided on the left and right sides in the fixing housing 41 of the fixing unit 40 (FIGS. 2 and 3). The compression springs 44 are coil springs, and bias the heating section 42 toward the pressurizing section 43 via not shown components.

In the fixing unit 40, a pressure corresponding to a load of 27 to 36 [kg] is desirably applied between the heating section 42 and the pressurizing section 43 due to the weight of the heating section 42, the biasing force of the compression spring 44, and the like. In this embodiment, the fixing unit 40 is operated in a state where a pressure corresponding to a load of 30 [kg] is applied between the heating section 42 and the pressurizing section 43.

Thus, in the fixing unit 40, the heating section 42 is pressed against the pressurizing section 43, and the pressurizing section 43 is elastically deformed to form a nip region N between the heating belt 72 and the pressurizing section 43. Inside the image forming apparatus 1 (FIG. 1), the fixing conveyance path W3 is formed along the nip region N. In the fixing unit 40, a nip width WN (FIG. 3), which is the length of the nip region N in the conveyance direction (i.e., substantially the front-back direction), is set to 8 to 11 [mm].

When the image forming apparatus 1 performs the printing process, the fixing unit 40 causes the heater 76 of the heating section 42 to generate heat and rotates the pressurizing section 43 to cause the heating belt 72 to circulate. In the fixing unit 40, when the medium M is conveyed along the fixing conveyance path W3, the medium M is nipped between the heating belt 72 and the pressurizing section 43 at the nip region N. At this time, the fixing unit 40 fixes the toner by applying heat and pressure thereto while moving the heating belt 72 at the same speed as the medium M in a state where the heating belt 72 is in contact with the medium M.

In the image forming apparatus 1, a highly resistant sheet such as so-called coated paper or water-resistant paper may be used. The highly resistant sheet is a sheet with which relatively high resistance is generated during feeding. Specifically, coated paper such as "Kaleka (registered trademark)" manufactured by Kokusai Pulp & Paper Co., Ltd., "Lamifree (registered trademark)" manufactured by Nakagawa Mfg. Co., Ltd., or "Eco Crystal (registered trademark)" manufactured by Tomoegawa Seisakusho Co., Ltd., or the like can be used. In this case, the image forming apparatus 1 reduces the conveyance speed of the medium M (i.e., the feeding speed) as compared to the case where plain paper is used, thereby enhancing the fixing efficiency of the toner to the medium M and improving the toner fixability.

In the image forming apparatus 1, the conveyance speed when using coated paper or the like can be set to approximately 50 to 80 [mm/s], and the nip width WN can be set to 8 to 11 [mm]. In this embodiment, the conveyance speed is set to 55 [mm/s], and the nip width WN is set to 11 [mm]. Thus, in the image forming apparatus 1, a passage time required for a predetermined point (i.e., a predetermined position) on the medium M to pass through the nip region N in the fixing unit 40 is approximately 0.2 [s].

In this embodiment, for example, when the conveyance speed of the medium M is 80 [mm/s] and the nip width WN is 8 [mm], the passage time required for a predetermined point of the medium M to pass through the nip region N is 0.1 [s]. For example, when the conveyance speed of the medium M is 50 [mm/s] and the nip width WN is 11 [mm], the passage time required for a predetermined point of the medium M to pass through the nip region N is 0.22 [s].

[3. Evaluation of Heating Belt]

The coated paper or the like described above has a structure in which a relatively thin surface layer of resin or the like is laminated on the surface of a base material made of paper (i.e., cellulose or the like). In the coated paper, relatively small irregularities formed on the surface of the base material are filled with the surface layer, so that the surface of the coated paper is formed more smoothly than plain paper. Thus, when an image is printed on the coated paper by the image forming apparatus 1 or the like, the printed image is expected to be uniformly glossy and to be high in quality.

However, in actual coated paper, due to irregularities formed on the base material, fine depressions D may be formed on the surface of the coated paper. The fine depression D has, for example, a circular or oval shape with a diameter or major axis of approximately 1 to 5 [mm] and a depth of approximately 10 [μm].

When a toner image is fixed to the medium M composed of such coated paper or the like, the fixing unit 40 desirably causes the heating belt 72 to partially deform to fill in the depressions D while the depressions D pass through the nip region N. This causes the surface of the heating belt 72 to come into contact with the inner surfaces of the depressions D so that toner is pressed against the surface of the medium M.

Meanwhile, in the image forming apparatus 1, as described above, when coated paper or the like is used as the medium M, the conveyance speed of the medium M is set to 55 [mm/s], and accordingly the passage time of the medium M through the nip region N of the fixing unit 40 is approximately 0.2 [s]. This means that, when the heating belt 72 deforms along a contour corresponding to the depressions D within 0.2 [s] after the heating belt 72 contacts the medium M and starts deforming, heat and pressure can be appropriately applied to the medium M. In other words, in the image forming apparatus 1, if the deformation speed, hardness and the like of the heating belt 72 of the fixing unit 40 are set within appropriate ranges, toner can be appropriately fixed even in the depressions D, and gloss can be given to an image.

Figure 6A:
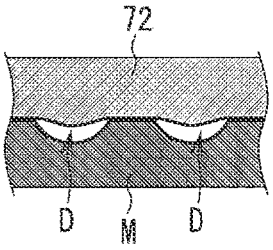
FIGS. 6A, 6B and 6C are schematic diagrams illustrating deformation of the heating belt according to a depression of a medium.
Figure 6B:
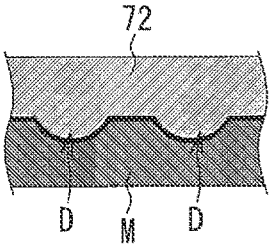
Figure 6C:
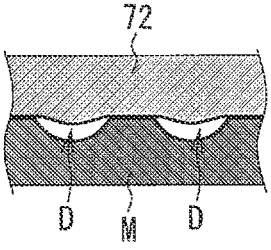

The relationship between the deformation speed or hardness of the heating belt 72 and the followability of the heating belt 72 to the medium M will be described with reference to FIGS. 6A to 6C. FIGS. 6A to 6C are schematic cross-sectional views illustrating the states in which the heating belt 72 contacts the surface of the medium M with the depressions D formed thereon at the nip region N.

For example, as illustrated in FIG. 6A, in a case where the hardness of the heating belt 72 is relatively low and the deformation speed of the heating belt 72 is relatively slow, the heating belt 72 cannot completely fill in the depressions D, and thus heat and pressure cannot be sufficiently transferred to the toner at the inner surfaces of the depressions D. In other words, the heating belt 72 exhibits low followability to the contour of the medium M having the depressions D or exhibits unsatisfactory responsiveness. Thus, the heating belt 72 cannot sufficiently follow the medium M within the passage time. In this case, gloss is not given to areas where the depressions D are formed, i.e., gloss unevenness occurs. Thus, image quality is evaluated to be low.

In contrast, as illustrated in FIG. 6B, in a case where the hardness of the heating belt 72 is within an appropriate range and the deformation speed of the heating belt 72 is within an appropriate range, the heating belt 72 can completely fill in the depressions D, and thus heat and pressure can be sufficiently transferred to the toner at the inner surfaces of the depressions D. In other words, the heating belt 72 exhibits high followability to the contour of the medium M having the depressions D, and exhibits favorable responsiveness. In this case, a sufficient gloss is given to the image even in areas where the depressions D are formed, and uniform gloss can be obtained across the surface of the medium M. Thus, image quality is evaluated to be high.

Furthermore, as illustrated in FIG. 6C, in a case where the hardness of the heating belt 72 is relatively high, the heating belt 72 cannot completely fill in the depressions D, and thus heat and pressure cannot be sufficiently transferred to the toner at the inner surfaces of the depressions D. In other words, the heating belt 72 exhibits low followability to the contour of the medium M having the depressions D, and exhibits the unsatisfactory responsiveness. In this case, gloss is not given to areas where the depressions D are formed, and gloss unevenness occurs as in the case of FIG. 6A. Thus, image quality is evaluated to be low.

Thus, in the fixing unit 40, it is thought that when the hardness and deformation speed of the heating belt 72 are set within appropriate ranges, the heating belt 72 can appropriately follow the contour of the medium M so that the toner can be suitably fixed to every part of the medium M. As a result, the possibility of occurrence of gloss unevenness can be reduced.

In order to measure the hardness of a relatively thin member such as the heating belt 72, a so-called microhardness tester is generally used. In the measurement using the microhardness tester, for example, a probe (also referred to as a measurement terminal) having a columnar shape or the like is brought into contact with a target member and pushed in the target member with a predetermined load or at a predetermined speed, whereby the hardness of the target member is measured based on an amount of displacement of the probe.

In this embodiment, the micro hardness tester "Micro Rubber Hardness Tester MD-1capa" manufactured by Kobunshi Keiki Co., Ltd., is used. In this embodiment, a probe having a cylindrical shape with a diameter of 0.16 [mm] is used for measurement, the descending speed of the probe (i.e., the pressing speed) is set to 3.2 [mm/s], and the load is set to 22 to 332 [Nm].

Figure 7:
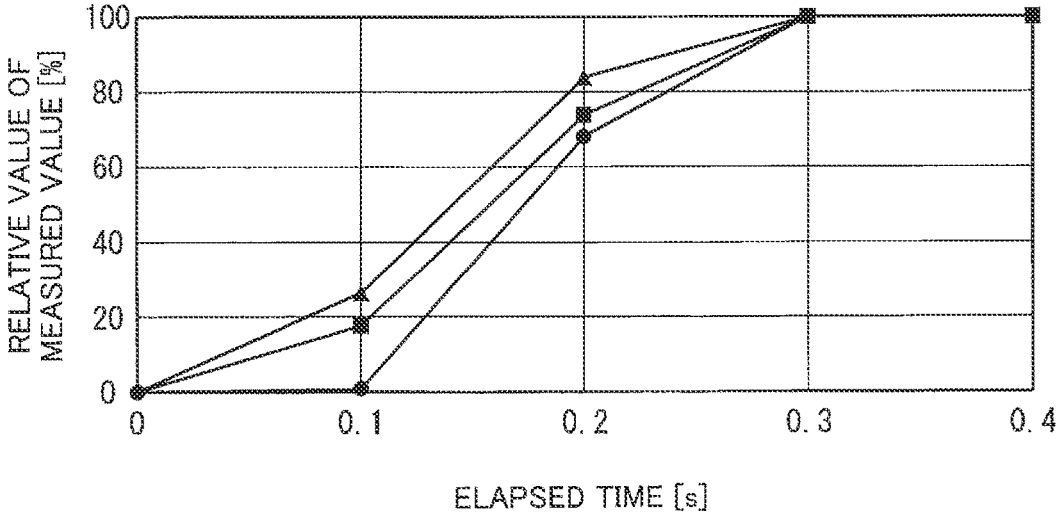
FIG. 7 is a schematic diagram showing changes over time in the measured values by a microhardness tester.

FIG. 7 is a graph illustrating examples of changes in measured values over time obtained using the microhardness tester for a plurality of heating belts 72 having different configurations. The vertical axis represents a hardness value that is converted to a relative value [%] with respect to a hardness value finally saturated (hereafter referred to as a saturation hardness value). The horizontal axis represents an elapsed time from the start of measurement. The elapsed time is plotted every 0.1 [s]. Hereinafter, a characteristic curve connecting the plots shown in FIG. 7 is also referred to as a profile.

In FIG. 7, a manner in which the measured value by the microhardness tester increases as the time elapses after the start of measurement can be observed. In FIG. 7, difference in the profile shape depending on the configuration of the heating belt 72 can also be observed. The difference in the profile shape of the heating belt 72 represents the difference of the deformation speed of the heating belt 72.

Therefore, in this embodiment, the microhardness tester is used to measure the hardness of the heating belt 72. Further, in this embodiment, a measured value at the time when 0.2 [s] has elapsed after the start of the measurement (hereinafter referred to as a hardness value after 0.2 s) is regarded as a value corresponding to the deformation speed of the heating belt 72. Hereinafter, 0.2 [s] described above is also referred to as a measurement time.

Further, in this embodiment, the relationship between a hardness value after 0.2 s of the heating belt 72 and the quality of an image printed on the medium M using the heating belt 72 is examined. In order to facilitate the comparison, the hardness value after 0.2 s is expressed as a ratio relative to the saturation hardness value which is the hardness value finally converged (hereinafter referred to as a hardness ratio after 0.2 s). That is, the hardness value is normalized. For convenience of explanation, the hardness value after 0.2 s and the saturation hardness value are also hereinafter referred to as a first hardness value and a second hardness value, respectively. The hardness value after 0.2 s is expressed as a ratio (A/B) of the first hardness value (A) to the second hardness value (B).

Specifically, in this embodiment, 12 types of heating belts 72 (72A to 72L) having various elastic layers 82 and surface layers 83 are prepared, and the hardness of each heating belt 72 is measured using the microhardness tester in an evaluation test. FIG. 8 is a table showing the specifications and measurement results of the respective heating belts 72 in the form of a table.

As the specifications of each heating belt 72, FIG. 8 shows the thickness [μm] of the elastic layer 82, the hardness [degree] of the elastic layer 82, and the thickness [μm] of the surface layer 83. FIG. 8 also shows measured values of the saturation hardness value [degree], the hardness value after 0.2 s [degree] of the heating belt 72, and the hardness ratio after 0.2 s calculated based on both measured values. Note that the values of the hardness ratio after 0.2 s are rounded to 3 decimal place.

Next, in this embodiment, a printing test is performed. In the printing test, a test image described later is printed on coated paper as the medium M using each of the heating belts 72 (72A to 72L) in the fixing unit 40 of the image forming apparatus 1. Then, printed images are evaluated. In the printing test, "C844" manufactured by Oki Electric Industry Co., Ltd. is used as the image forming apparatus 1.

In the printing test, an image whose entire surface is uniformly black (so-called full solid image) is printed as the test image. When gloss unevenness appears on the medium M after printing, it is thought that fine irregularities are formed on the surface of the medium M and make the surface non-planar. That is, it is thought that the degree of gloss unevenness increases as the area of planar parts of the medium M decreases and the area of non-planar parts of the medium M increases.

For this reason, in this embodiment, as for evaluation of the printing results on the media M, the printing results are classified into multiple levels based on the ratio of the area of planar parts to the entire surface of the medium M. Each classified level has a high correlation with the degree of gloss unevenness. That is, in this embodiment, the ratio of the planar parts to the entire surface of the medium M after the printing is used as an objective index representing the degree of gloss unevenness on the medium M.

Specifically, in this embodiment, the test image is printed on the medium M by the image forming apparatus 1 that incorporates each heating belt 72 in the fixing unit 40. In this embodiment, "Lamifree (registered trademark)" manufactured by Nakagawa Mfg. Co., Ltd. is used as the medium M.

Then, in this embodiment, the surface contour of the medium M is observed using a laser microscope, and microscopic images are captured. In this embodiment, a confocal microscope "OPTELICS (registered trademark) HYBRID" manufactured by Lasertec Corporation is used as the laser microscope.

Subsequently, in this embodiment, a binarization process is performed on the microscope image obtained using the laser microscope based on the luminance of each pixel in the microscope image, thereby classifying the image into planar parts and non-planar parts. Further, in this embodiment, the ratio of the area of the planar parts to the area of the entire microscopic image is calculated, and the calculated value is defined as a toner planar area ratio [%]. The settings of the laser microscope are provided below.

Light intensity: 50[%]
Brightness: 500
Objective lens: 10× (magnification of 185)
Number of patchwork sheets: 8 vertical×8 horizontal (11 [mm]×11 [mm] image region)
Binarization method: Luminance value
Extraction threshold of planar part: 85 to 190 (luminance value)

Further, in this embodiment, the following thresholds for calculated values of the toner planar area ratio [%] of each heating belt are set. Using the thresholds, calculated values of the toner planar area ratio are classified into five evaluation levels, namely, "Level 1" in which the degree of gloss unevenness is relatively high to "Level 5" in which gloss unevenness is hardly observed. By visually observing the states of gloss unevenness of a plurality of media M having various toner planar area ratios [%], the thresholds for the respective evaluation levels are appropriately set so that differences in the gloss unevenness between the respective levels are significantly noticeable.

Figure 9:
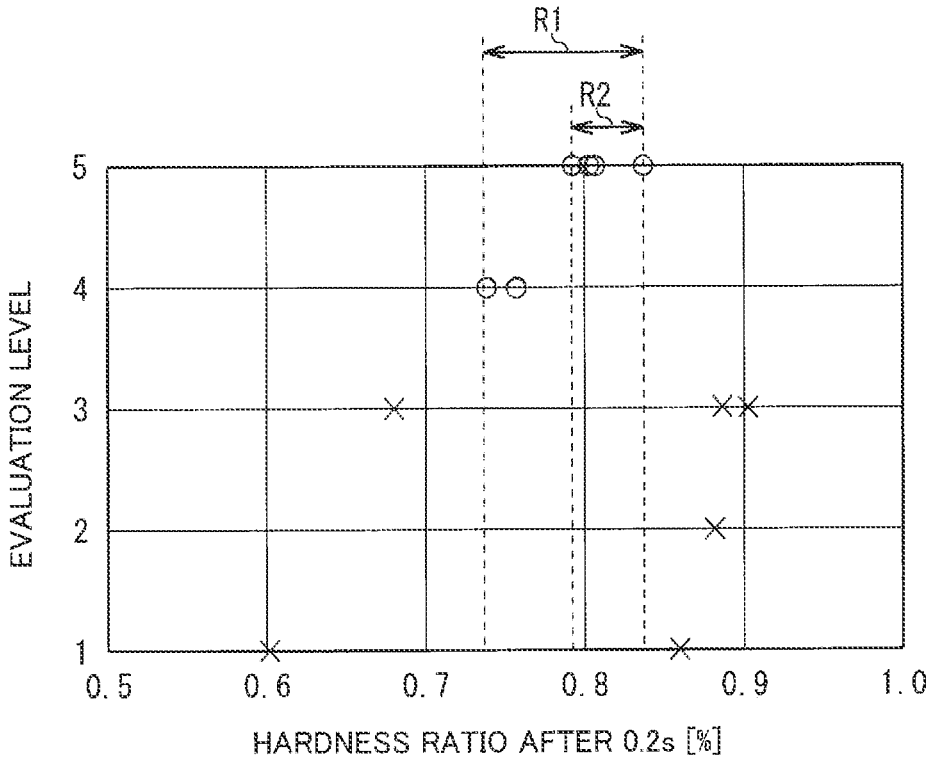
FIG. 9 is a schematic diagram showing the relationship between a hardness ratio after 0.2 s and an evaluation level of the heating belt.

Level 1: less than 31.2 [%]
Level 2: 31.2 [%] or more and less than 35.9 [%]
Level 3: 35.9 [%] or more and less than 40.6 [%]
Level 4: 40.6 [%] or more and less than 45.3 [%]
Level 5: 45.3 [%] or more Such an evaluation test is conducted using each heating belt 72, and evaluation levels are obtained as shown in FIG. 8. FIG. 9 is a graph obtained by plotting the evaluation levels of the respective heating belts 72. In FIG. 9, the horizontal axis represents the hardness ratio after 0.2 s and the vertical axis represents the evaluation level. In FIG. 9, plots where the evaluation level is Level 4 or higher are indicated by the symbol "○" (good), and plots where the evaluation level is Level 3 or lower are indicated by the symbol "X" (poor). Hereinafter, the correlation between the hardness ratio after 0.2 s, the evaluation level in the evaluation test and the like will be described with reference to FIGS. 8 and 9.

In this evaluation test, when a value of the hardness ratio after 0.2 s is within a range R1 of 0.738 (73.8%) to 0.837 (83.7%), the evaluation level is Level 4 or higher. It is thought that in the fixing unit 40, the heating belt 72 exhibits relatively quick responsiveness to the pressing and exhibits high followability to the depressions D formed on the medium M as illustrated in FIG. 6B. Thus, the image forming apparatus 1 can uniformly apply heat and pressure to every part of the medium M at the nip region N of the fixing unit 40, so that gloss unevenness in the image printed on the medium M can be suitably reduced. In this case, the hardness of the elastic layer 82 is within a range of 12 to 20 [degree], and the hardness value after 0.2 s is within a range of 56.4 to 65.5 [degree].

In addition, in this evaluation test, when a value of the hardness ratio after 0.2 s [%] is within a range R2 of 0.793 (79.3%) to 0.837 (83.7%), the evaluation level is Level 5. It is thought that in the fixing unit 40, the heating belt 72 exhibits further quick responsiveness to the pressing, and exhibits higher followability to the depressions D formed on the medium M. Thus, the image forming apparatus 1 can significantly reduce gloss unevenness in the image printed on the medium M, and remarkably high image quality can be obtained.

On the other hand, in this evaluation test, when a value of the hardness ratio after 0.2 s is less than 0.738, the evaluation level is Level 3 or lower. It is thought that in the fixing unit 40, the heating belt 72 exhibits relatively slow responsiveness to the pressing, and exhibits low followability to the depressions D formed on the medium M as illustrated in FIG. 6A. As a result, the image forming apparatus 1 causes more gloss unevenness in the image printed on the medium M.

In addition, in this evaluation test, when a value of the hardness ratio after 0.2 s [%] is more than 0.837, the evaluation level is Level 3 or lower. It is thought that in the fixing unit 40, the heating belt 72 is relatively hard, and the elastic deformability of the heating belt 72 is relatively low, so that the heating belt 72 exhibits low followability to the depressions D formed on the medium M as illustrated in FIG. 6C. As a result, the image forming apparatus 1 causes more gloss unevenness in the image printed on the medium M.

In this way, this evaluation test shows that the degree of gloss unevenness in the image printed on the medium M changes depending on the value of the hardness ratio after 0.2 s. This evaluation test also shows the range of the hardness ratio after 0.2 s and the range of the hardness value after 0.2 s with which the degree of gloss unevenness can be suitably reduced.

Based on the above, the fixing unit 40 of the image forming apparatus 1 according to this embodiment includes the heating belt 72 in which the value of the hardness ratio after 0.2 s is at least within the range R1 of 0.738 to 0.837, and preferably within the range R2 of 0.793 to 0.837.

[4. Advantages and the Like]

With the configuration described above, in the image forming apparatus 1 of this embodiment, the heating belt 72 of the fixing unit 40 sufficiently deforms within a time during which the medium M passes through the nip region N in the case of printing an image on the medium M of coated paper.

Specifically, the image forming apparatus 1 has the heating belt 72 in which the value of the hardness ratio after 0.2 s measured by the microhardness tester is at least within the range R1 of 0.738 to 0.837.

Thus, in the image forming apparatus 1, the heating belt 72 can sufficiently deform to fit the depressions D on the medium M within approximately 0.2 [s] during which the medium M passes through the nip region N of the fixing unit 40. Thus, the heating belt 72 can be brought into contact with the surfaces of the depressions D (FIG. 6B). Thus, the image forming apparatus 1 can sufficiently fix the toner to both of planer parts and the depressions D on the medium M by applying heat and pressure using the heating belt 72. Therefore, uniform gloss can be given to the image printed on the medium M without any gloss unevenness.

In the image forming apparatus 1, when the hardness value after 0.2 s of the heating belt 72 of the fixing unit 40 is 56.4 [degree] or more and 65.5 [degree] or less, the evaluation level is Level 4 or higher (FIG. 8), and thus gloss unevenness can be suitably suppressed.

Furthermore, the image forming apparatus 1 may also include the heating belt 72 of the fixing unit 40 in which the value of the hardness ratio after 0.2 s is within the range R2 of 0.793 to 0.837. In this case, the image forming apparatus 1 can more suitably fix the toner to both of planer parts and the depressions D on the medium M by the heating belt 72. Thus, gloss unevenness in the image printed on the medium M can be more suitably suppressed, and gloss can be more suitably given to the image printed on the medium M.

In particular, in this embodiment, among measured values by the microhardness tester, the hardness value after 0.2 s (i.e., the value at the time when 0.2 [s] has elapsed after the start of measurement) is used in addition to the saturation hardness value. In this embodiment, 0.2 [s] is regarded as the time required for the medium M to pass through the nip region N. Specifically, this time is calculated based on the conveyance speed of the medium M and the nip width WN which is the length of the nip region N. Thus, in the image forming apparatus 1, it is possible to employ the appropriate heating belt 72 that completely finishes deforming to fit the depressions D within a time during which the medium M passes through the nip region N.

Furthermore, it is confirmed in this embodiment that as long as a value of the hardness ratio after 0.2 s is at least within the range R1 of 0.738 to 0.837, gloss unevenness can be suitably suppressed by modifying the conveyance speed and the nip width WN even if the passage time required for the medium to pass through the nip region N is changed to a time between 0.1 [s] and 0.2 [s].

Therefore, when a value of the hardness ratio of the heating belt 72 reaches a value of 0.738 or more and 0.837 or less until the medium M finishes passing through the nip region N, gloss unevenness can be suppressed in both of the planer parts and the depressions D on the medium M. That is, regarding the condition required for the heating belt 72, an elapsed time after the start of measurement by the microhardness tester and the passage time through the nip region N are not necessarily identical to each other. For example, the condition required for the heating belt 72 may be set so that a value of the hardness ratio is within the range R1 of 0.738 to 0.837 at a time when 0.16±0.06 [s] has elapsed after the start of measurement by the microhardness tester.

From another viewpoint, in this embodiment, the microhardness tester is used by a method partially different from the normal method. In the normal method using the microhardness tester, a probe is pressed against a target to be measured, and when a certain period of time has elapsed and a measured value becomes stable, the measured value at this time (i.e., the saturation hardness value) is used as the measurement value.

In contrast, in this embodiment, a change in the heating belt 72 over time caused by being pressed by the probe of the microhardness tester is considered to be very close to a change in the heating belt 72 over time caused by contact with the depressions D on the medium M. Thus, in this embodiment, the change in the contour of the heating belt 72 over time can be grasped by sequentially reading the change in the measured value over time by the microhardness tester.

From a further viewpoint, the image forming apparatus 1 is configured so that the nip width WN of the nip region N is as large as possible in order to suitably fix the toner to the medium M. Specifically, in the fixing unit 40 (FIG. 3), the heating section 42 is not in the form of a roller such as the pressurizing section 43, but is in the form of the heating belt 72 that moves around the heating central portion 71. The heater 76, the partition plate 77, and the like which are provided in the heating central portion 71 have sufficient length in the front-back direction. In the fixing unit 40 configured in this way, the heating belt 72 that moves around the heating central portion 71 is required to be formed relatively thin, and it is difficult for the heating belt 72 to have a sufficient thickness. As a result, it is conventionally difficult to select an appropriate hardness of the heating belt 72.

From this point, in this embodiment, the favorable ranges R1 and R2 (FIG. 9) are specified by using the harness ratio after 0.2 s as an index while focusing on the followability and responsiveness of the heating belt 72 within the passage time during which the medium passes through the nip region N (i.e., 0.2 [s]). Consequently, in the image forming apparatus 1, the followability and responsiveness of the heating belt 72 formed relatively thin can be enhanced appropriately, while securing a relatively large nip width WN in the fixing unit 40 (FIG. 3). Thus, favorable gloss can be given to the formed image.

In this embodiment, the toner planar area ratio based on the luminance of each pixel in the microscope image is used as an index, and the evaluation level is classified according to the value of the toner planar area ratio. Thus, in this embodiment, regarding the presence or absence and the degree of gloss unevenness, an objective evaluation level can be appropriately determined for each heating belt 72 based on clear classification according to the uniform standards, rather than ambiguous classification depending on visual observation. As a result, in the image forming apparatus 1, an image having sufficient gloss such as an image with little gloss unevenness can be printed on the medium M by using the appropriate heating belt 72 selected based on the appropriately evaluated level.

With the configuration described above, when an image is printed on the medium M of the coated paper, the heating belt 72 of the fixing unit 40 in the image forming apparatus 1 is configured so that a value of its hardness ratio after 0.2 s measured using the microhardness tester is at least within the range R1 of 0.738 to 0.837. Thus, in the image forming apparatus 1, the heating belt 72 can sufficiently deform to fit the depressions D on the medium M within approximately 0.2 [s] during which the medium M passes through the nip region N of the fixing unit 40. Thus, the image forming apparatus 1 can sufficiently fix the toner to both the planer parts and the depressions D on the medium M. Therefore, gloss unevenness in the image printed on the medium M can be suppressed, and uniform gloss can be given to the image printed on the medium M.

[5. Modifications]

In the above-described embodiment, the nip width WN of the fixing unit 40 is 8 to 11 [mm], the conveyance speed of the medium M is 55 [mm/s], and the passage time required for a predetermined point on the medium M to pass through the nip region N is approximately 0.2 [s]. Accordingly, the heating belt 72 is evaluated using the hardness value after 0.2 s and the hardness ratio after 0.2 s. However, the present disclosure is not limited thereto, and the passage time may be set to various times, for example, 0.1 [s], 0.4 [s], or the like, by setting the nip width WN in the fixing unit 40 and the conveyance speed of the medium M to various values. In this case, in accordance with the passage time, the hardness or hardness ratio at the time when the passage time has elapsed after the start of measurement may be used. Alternatively, the hardness or hardness ratio at a time shorter than the passage time may be used.

In the above-described embodiment, the toner planar area ratio is calculated based on the luminance value of the microscopic image obtained using the laser microscope in the evaluation test of the heating belt 72, and the heating belt 72 is evaluated by classification into the five evaluation levels (Level 1 to Level 5) using the calculated toner planar area ratio. However, the present disclosure is not limited thereto. The classification into respective evaluation levels may be carried out by using various methods, such as the subjective classification based on the evaluator's visual inspection, for example. The number of evaluation levels for the classification is not limited to five, but may be four or less, or six or more.

Further, in the above-described embodiment, the thickness of the base 81 in the heating belt 72 is approximately 70 to 90 [μm], the thickness of the elastic layer 82 is approximately 150 to 300 [μm], and the thickness of the surface layer 83 is approximately 13 to 30 [μm] (FIG. 8). However, the present disclosure is not limited thereto, and the thicknesses of the base 81, elastic layer 82, and surface layer 83 may be set to other respective values.

Furthermore, in the above-described embodiment, the hardness of the elastic layer 82 in the heating belt 72 is 12 to 20 [degree]. However, the present disclosure is not limited thereto, and the hardness of the elastic layer 82 may be set to other various values.

Moreover, in the above-described embodiment, the pressurizing section 43 of the fixing unit 40 (FIGS. 2, 3 and 5) is configured as a pressure roller that has the elastic layer 92 or the like formed on the outer circumferential surface of the central material 91. However, the present disclosure is not limited thereto, and the pressurizing section 43 may be configured in various ways. For example, it is possible to employ a combination of a heating central portion and a heating belt as in the heating section 42.

In addition, the above-described embodiment uses the medium M, such as coated paper, that has the surface layer of resin or the like provided on the surface of paper as the base material with fine depressions D formed on the surface of the surface layer. However, the present disclosure is not limited thereto and may use various media with fine depressions or irregularities formed on their surfaces as in coated paper.

Furthermore, in the above-described embodiment, by using the microhardness tester, a columnar probe is pressed into the heating belt 72 as the target to be measured, and the hardness of the heating belt 72 is measured based on an amount of displacement of the probe. However, the present disclosure is not limited thereto, and other probes with various shapes, such as a probe having a hemispherical tip and a probe having an elliptical columnar tip, may be used. Alternatively, the hardness testers that measure the hardness of the target to be measured by various other methods may be used. In this case, any other means that can acquire a change over time in the physical quantity corresponding to the amount of displacement of the probe may be used. Regarding various values on the microhardness tester, the diameter of the probe may be set to a value other than 0.16 [mm], the descending speed of the probe may be set to a value other than 3.2 [mm/s], and the load may be set to a value that is not between 22 and 332 [Nm].

Moreover, in the above-described embodiment, the image forming apparatus 1 includes four developing units 30 (FIG. 1). However, the present disclosure is not limited thereto. For example, the image forming apparatus 1 may include one to three or five or more developing units 30.

Furthermore, in the above-described embodiment, the present disclosure is applied to the image forming apparatus 1, which is a single-function SFP. However, the present disclosure is not limited thereto, and may be applied to image forming apparatuses with various other functions, such as a Multi Function Peripheral (MFP) that has the functions of a copier and a facsimile machine, for example.

The present disclosure is not limited to the above-described embodiment and modifications. That is, the present disclosure can also be applied to any embodiments obtained by appropriately combining some or all of the respective embodiments and modifications described above, as well as any embodiment obtained by extracting parts of the above embodiment and modifications therefrom.

Furthermore, in the above-described embodiment, the heating belt 72 as the annular belt and the pressurizing section 43 as the facing member constitute the fixing unit 40 as the fixing device. However, the present disclosure is not limited thereto, and a facing member and an annular belt, which can have various other configurations, may constitute the fixing device.

The present disclosure can be used, for example, when a toner image formed on a medium by an electrophotographic method is fixed to the medium by a fixing unit.

DESCRIPTION OF REFERENCE CHARACTERS

1 image forming apparatus; 20 transfer unit; 30 developing unit; 40 fixing unit (fixing device or fuser); 42 heating section; 43 pressurizing section; 71 heating central portion; 72 heating belt; 73 support body; 74 support body; 75 heat transfer plate; 76 heater; 77 partition plate; 78 temperature sensor; 81 base; 82 elastic layer; 83 surface layer; 91 central material; 92 elastic layer; 93 primer layer; 94 surface layer; M medium; D depression; N nip region; WN nip width; R1 range; R2 range.

What is claimed is:

1. A fixing device comprising:

an annular belt having an outer circumferential surface; and a facing member that faces the outer circumferential surface of the annular belt to form a nip region between the annular belt and the facing member, wherein the annular belt is configured so that in measurement of a hardness of the outer circumferential surface using a hardness tester, assuming that a first hardness value (A) represents a measured value at a time when a measurement time corresponding to a time required for a predetermined point on the outer circumferential surface to pass through the nip region has elapsed after start of the hardness measurement, and that a second hardness value (B) represents a measured value at a time when the measured value by the hardness tester is saturated, a ratio (A/B) of the first hardness value (A) to the second hardness value (B) is 0.738 or more and 0.837 or less.

2. The fixing device according to claim 1, wherein the hardness tester applies a predetermined load to a measurement terminal and presses the measurement terminal in the outer circumferential surface to be measured at a predetermined pressing speed, thereby obtaining the first hardness value and the second hardness value based on an amount of displacement of the measurement terminal.

3. The fixing device according to claim 1, wherein the ratio (A/B) of the annular belt is 0.793 or more and 0.837 or less.

4. The fixing device according to claim 1, wherein the annular belt comprises:

a base;

a surface layer provided on an outer side of the base to form the outer circumferential surface; and an elastic layer provided between the base and the surface layer.

5. The fixing device according to claim 4, wherein the base has a thickness of 70 to 90 [μm];

wherein the elastic layer has a thickness of 150 to 300 [μm]; and wherein the surface layer has a thickness of 13 to 30 [μm].

6. The fixing device according to claim 4, wherein the elastic layer has a hardness of 12 to 20 [degree].

7. The fixing device according to claim 1, wherein the facing member is a roller that has an elastic layer formed on a circumferential surface of a center shaft rotatably supported.

8. The fixing device according to claim 1, further comprising:

a heating member disposed at a position that faces the facing member on an inner circumferential side of the annular belt.

9. The fixing device according to claim 8, wherein the heating member is provided on the inner circumferential surface of the annular belt and heats the annular belt at the nip region.

10. An image forming apparatus comprising:

a developing unit that causes a developer image using a developer to adhere to a surface of a medium; and the fixing device according to claim 1 that fixes the developer image to the medium.

11. A fixing device comprising:

an annular belt having an outer circumferential surface; and a facing member that faces the outer circumferential surface of the annular belt to form a nip region between the annular belt and the facing member, wherein the annular belt comprises:

a base;

an elastic layer formed on a surface of the base and having a thickness of 250 to 300 [μm]; and a surface layer formed on a surface of the elastic layer and having a thickness of 15.0 to 29.6 [μm], and wherein the annular belt is configured so that in measurement of a hardness of the outer circumferential surface using a hardness tester, a measured value is 56.4 [degree] or more and 65.5 [degree] or less when a measurement time corresponding to a time required for a predetermined point on the outer circumferential surface to pass through the nip region has elapsed after start of the hardness measurement.

12. The fixing device according to claim 11, wherein the elastic layer has a hardness of 12 to 20 [degree].

13. The fixing device according to claim 11, further comprising:

a heating member disposed at a position that faces the facing member on an inner circumferential side of the annular belt.

14. The fixing device according to claim 13, wherein the heating member is provided on the inner circumferential surface of the annular belt and heats the annular belt at the nip region.

15. An image forming apparatus comprising:

a developing unit that causes a developer image using a developer to adhere to a surface of a medium; and the fixing device according to claim 11 that fixes the developer image to the medium.

* * * * *